US006637039B1

(12) United States Patent
Manuel

(10) Patent No.: US 6,637,039 B1
(45) Date of Patent: Oct. 28, 2003

(54) NECK AND EAR PROTECTION DEVICE

(76) Inventor: Grace Manuel, 43555 Grimmer Blvd. #M2104, Fremont, CA (US) 94538

( * ) Notice: Subject to any disclaimer, the term of this patent is extended or adjusted under 35 U.S.C. 154(b) by 0 days.

(21) Appl. No.: 10/185,700

(22) Filed: Jun. 28, 2002

(51) Int. Cl.[7] ..... A42B 1/06
(52) U.S. Cl. ..... 2/468; 2/209; 128/866; 132/212
(58) Field of Search ..... 2/468, 209, 423, 2/174, 7, 8, 81, 171, 172; 132/212, 333; 128/864, 866

(56) References Cited

U.S. PATENT DOCUMENTS 2,124,431 A * 7/1938 Praytor ..... 2/174
2,149,210 A * 2/1939 Fairchild ..... 2/174
2,729,823 A * 1/1956 Foster ..... 2/174
3,235,882 A * 2/1966 Coleman ..... 2/174
5,628,070 A 5/1997 Kefelian
5,718,001 A 2/1998 Wright
6,131,204 A 10/2000 Otey
6,505,633 B2 * 1/2003 Mosely ..... 132/319

* cited by examiner

*Primary Examiner*—Tejash Patel

(57) ABSTRACT

A neck and ear protection device for protecting the skin the ears and neck region from being burned by heated air from a hair dryer. The neck and ear protection device includes a base portion being shaped for being positioned around the neck of the user. The base portion is designed for protecting skin of the neck of the user from direct contact with the heated air. A pair of ear portions are coupled to the base portion. Each of the ear portions is positioned whereby the ear portions are diametrically opposed when the base portion is positioned around the neck of the user. Each of the ear portions is shaped for receiving one of the ears of the user. The ear portions are designed for preventing direct contact between the heated air of the hair dryer and the skin of the ears.

8 Claims, 4 Drawing Sheets

NECK AND EAR PROTECTION DEVICE

BACKGROUND OF THE INVENTION

1. Field of the Invention

The present invention relates to burn protector coverings and more particularly pertains to a new neck and ear protection device for protecting the skin the ears and neck region from being burned by heated air from a hair dryer.

2. Description of the Prior Art

The use of burn protector coverings is known in the prior art. U.S. Pat. No. 5,628,070 describes a device for extending around the forehead and draping down the back of the neck of the user to prevent the user being burned by a curling iron. Another type of burn protector covering is U.S. Pat. No. 5,718,001 having an ear covering device for protecting the ears from heat and hair dressing preparations. U.S. Pat. No. 6,131,204 has a ensemble with a individual ear coverings and an individual neck covering to protect the neck and ears of the user from being burned by heated air from a hair dryer.

While these devices fulfill their respective, particular objectives and requirements, the need remains for a device that has certain improved features that protect the base of the skull of the user and a portion of the upper torso of the user.

SUMMARY OF THE INVENTION

The present invention meets the needs presented above by proving a securing portion positioned between the ear portions to protect the exposed skin at the base of the user's skull and a cowl portion extending from the base portion to cover a portion to the upper torso of the user.

Still yet another object of the present invention is to provide a new neck and ear protection device that covers a greater portion of the skin from coming into contact with the heated air from the hair dryer.

To this end, the present invention generally comprises a base portion being shaped for being positioned around the neck of the user. The base portion is designed for protecting skin of the neck of the user from direct contact between the heated air of the hair dryer and the skin of the neck, so that the skin is not burned by the hot air from the hair dryer. A pair of ear portions are coupled to the base portion. Each of the ear portions is positioned whereby the ear portions are diametrically opposed when the base portion is positioned around the neck of the user. Each of the ear portions is shaped for receiving one of the ears of the user. The ear portions are designed for preventing direct contact between the heated air of the hair dryer and the skin of the ears.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
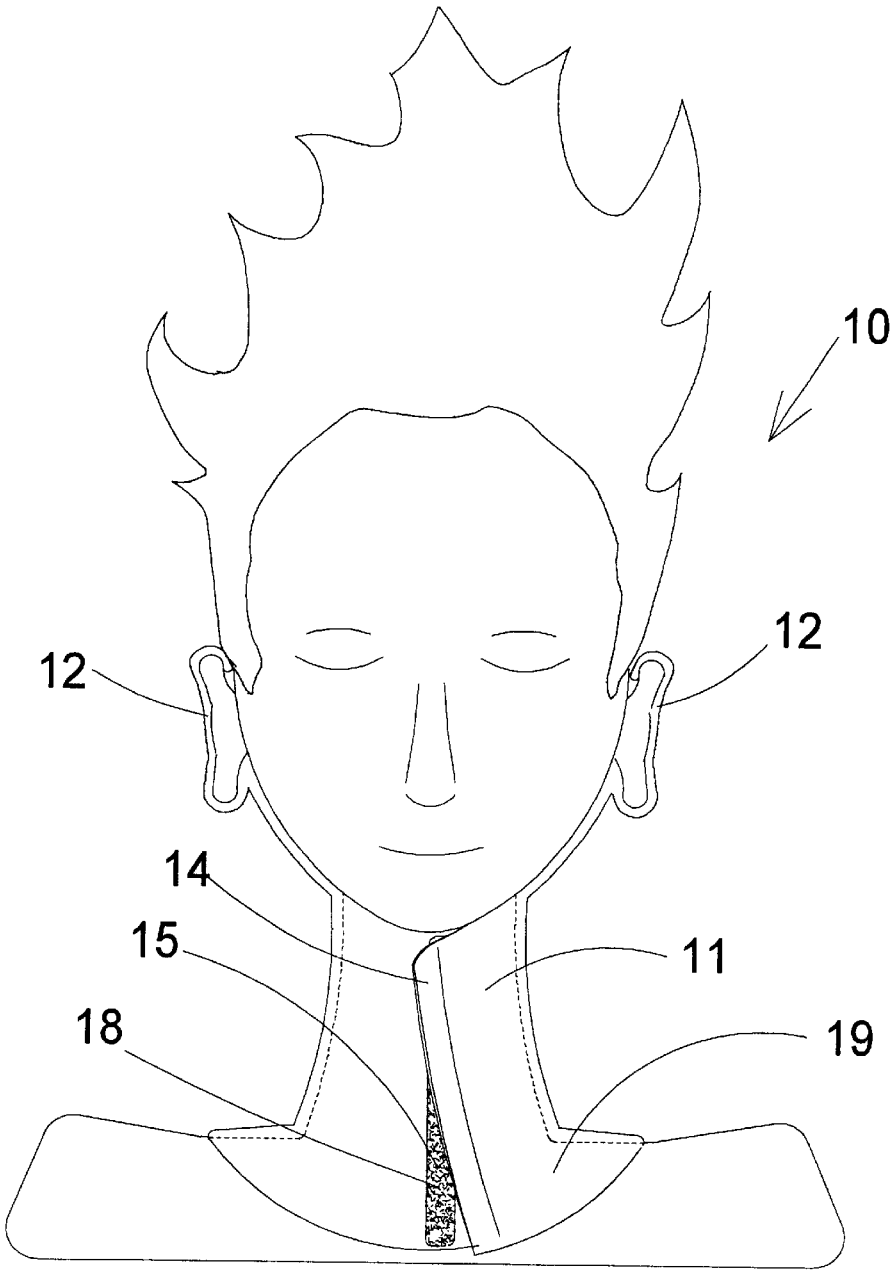
FIG. 1 is a front view of a new neck and ear protection device according to the present invention shown in use.
Figure 2:
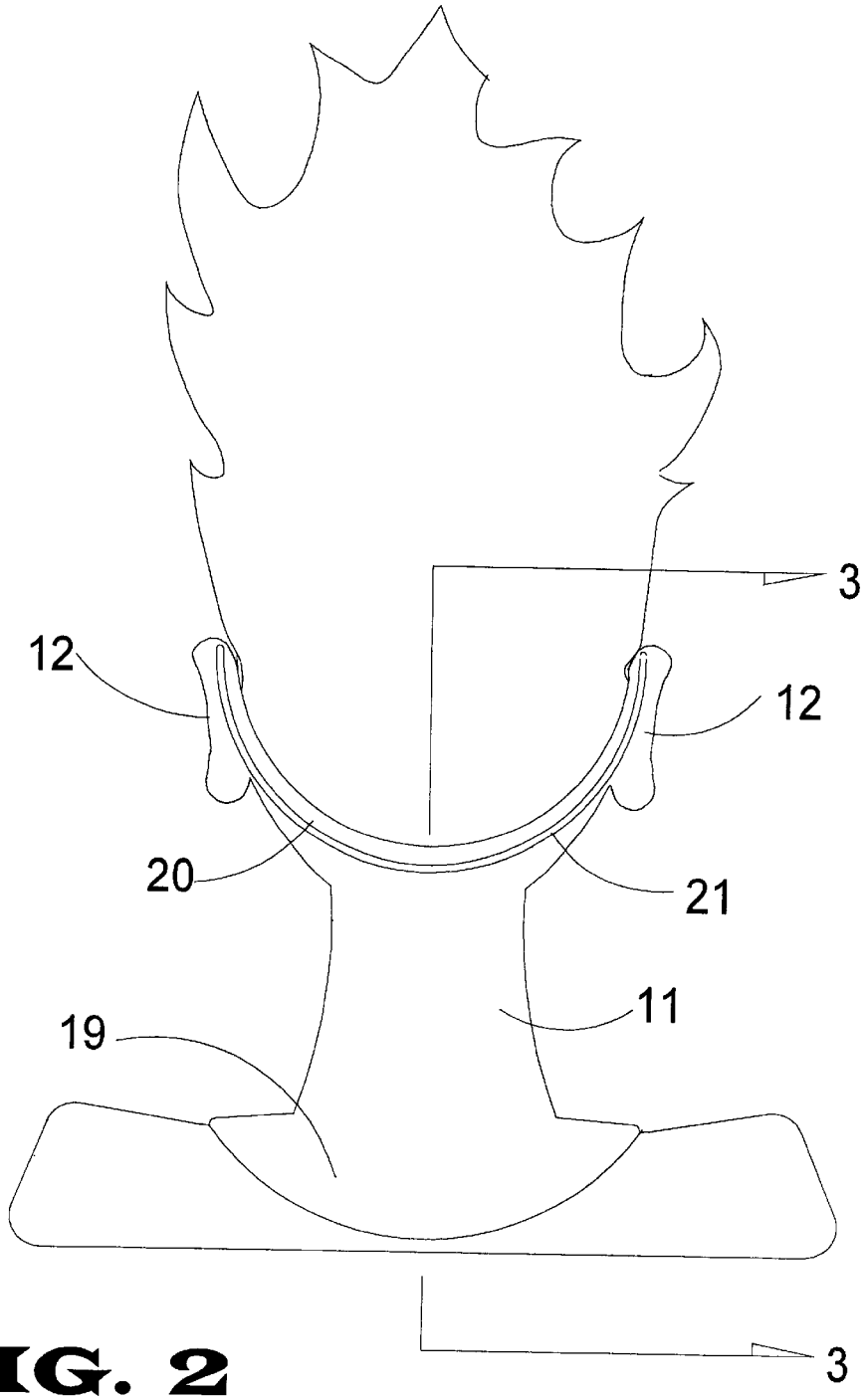
FIG. 2 is a rear view of the present invention shown in use.
Figure 3:
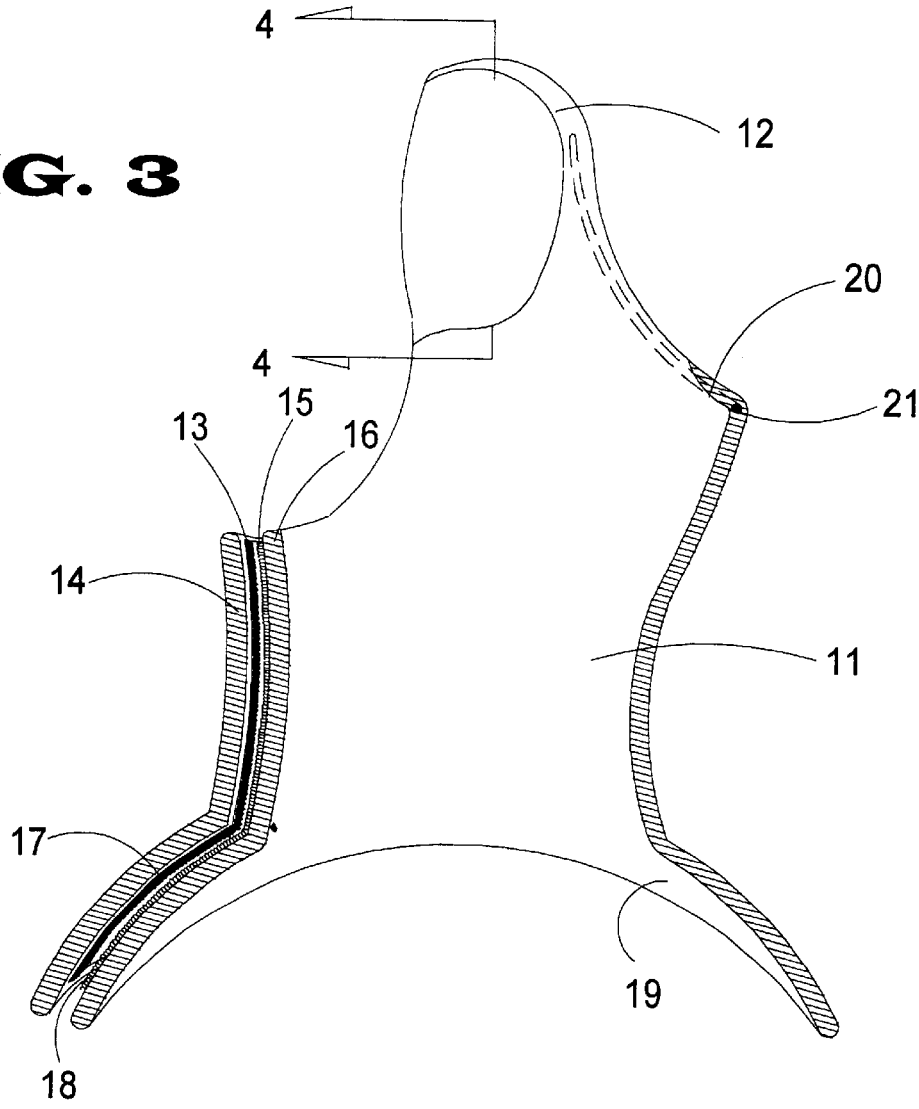
FIG. 3 is a cross-sectional view of the present invention taken along line 3—3 of FIG. 2.
Figure 4:
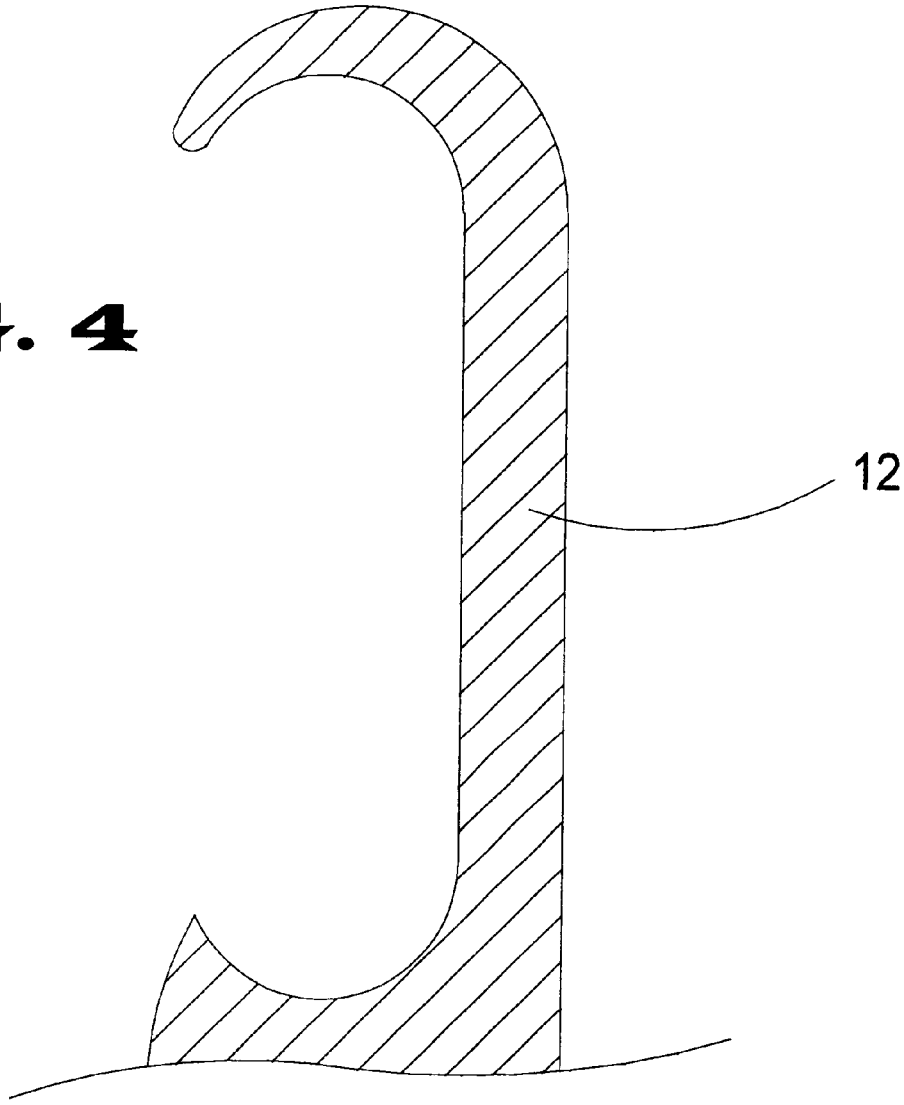
FIG. 4 is a cross-sectional view of one of the ear portions of the present invention taken along line 4—4 of FIG. 3.

With reference now to the drawings, and in particular to FIGS. 1 through 4 thereof, a new neck and ear protection device embodying the principles and concepts of the present invention and generally designated by the reference numeral 10 will be described.

As best illustrated in FIGS. 1 through 4, the neck and ear protection device 10 generally comprises a base portion 11 being shaped for being positioned around the neck of the user. The base portion 11 is designed for protecting skin of the neck of the user from direct contact between the heated air of the hair dryer and the skin of the neck, so that the skin is not burned by the hot air from the hair dryer.

A pair of ear portions 12 are coupled to the base portion 11. Each of the ear portions 12 is positioned whereby the ear portions 12 are diametrically opposed when the base portion 11 is positioned around the neck of the user. Each of the ear portions 12 is shaped for receiving one of the ears of the user. The ear portions 12 are designed for preventing direct contact between the heated air of the hair dryer and the skin of the ears.

A first fastening member 13 is coupled adjacent a first free edge 14 of the base portion 11. A second fastening member 15 is coupled adjacent a second free edge 16 of the base portion 11. The first fastening member 13 is selectively couplable to the second fastening member 15 for securing the base portion 11 around the neck of the user.

The first fastening member 13 comprises a first portion of hook and loop fastener 17. The second fastening member 15 comprises a second portion of hook and loop fastener 18. The first portion of hook and loop fastener 17 is complimentary to the second portion of hook and loop fastener 18 whereby the first portion of hook and loop fastener 17 releaseably engages the second portion of hook and loop fastener 18 for securing the base portion 11 around the neck of the user.

A cowl portion 19 is coupled to the base portion 11. The cowl portion 19 is positioned opposite the ear portions 12. The cowl portion 19 is designed for covering a portion of a back, front and shoulders of the user for protecting the skin of the portion of the back, front and shoulders from direct contact with heated air from the hair dryer.

A securing portion 20 is coupled to the base portion 11 whereby the securing portion 20 extends between the ear portions 12. The securing portion 20 is designed for engaging a portion of a base of a skull of the user whereby the securing portion 20 is positioned adjacent a hair line of the user. The securing portion 20 is designed for protecting the skin of the portion of the base of the skull of the user from direct contact with heated air from the hair dryer.

A position member 21 is positioned in the securing portion 20. The position member 21 is designed for conforming to the portion of the base of the skull of the user. The position member 21 comprises a substantially rigid material. The substantially rigid material is designed for conforming to the portion of the base of the skull of the user for maintaining the securing portion 20 against the base of the skull of the user.

In use, the user places the base portion 11 around the back of the neck and secures the first free edge 14 and the second free edge 16 together in front of the neck. The cowl portion 19 radially extends from the base portion 11 to cover a portion of the upper torso of the user. The ears of the user are positioned in the ear portions 12 so that the ears are covered. The securing portion 20 is then adjusted to be positioned along the hair line along the back of the head. The user can then use a hair dryer to dry their hair and prevent burning of the skin from prolonged contact to the hot air from the dryer.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A neck and ear protection device for protecting the ears and neck of a user from being burned when the user is using a hair dryer, the neck and ear protection device comprising:

a base portion being shaped for being positioned around the neck of the user, said base portion being adapted for protecting skin of the neck of the user from direct contact between the heated air of the hair dryer and the skin of the neck, said base portion comprising a rear portion and a pair of side portions, said side portions being oppositely coupled to said rear portion such that said side portions are selectively coupled together opposite said rear portion to form a cylinder said rear portion being adpted for covering a back of the neck of the user such that each said side portions is for covering a side of the neck and a portion of the front of the neck to protect the neck from the heated air of the hair dryer, said base portion being adapted for extending the length of the neck to protect the neck from the heated air of the hair dryer; and a pair of ear portions being coupled to said base portion, each of said ear portions being positioned such that said ear portions are diametrically opposed when said base portion is positioned around the neck of the user, each of said ear portions being shaped for receiving one of the ears of the user, said ear portions being adapted for preventing direct contact between the heated air of the hair dryer and the skin of the ears.

2. The neck and ear protection device as set forth in claim 1, further comprising:

a first fastening member being coupled adjacent a first free edge of said base portion, a second fastening member being coupled adjacent a second free edge of said base portion, said first fastening member being selectively couplable to said second fastening member for securing said base portion around the neck of the user.

3. The neck and ear protection device as set forth in claim 2, further comprising:

said first fastening member comprising a first portion of hook and loop fastener, said second fastening member comprising a second portion of hook and loop fastener, said first portion of hook and loop fastener being complimentary to said second portion of hook and loop fastener such that said first portion of hook and loop fastener releaseably engages said second portion of hook and loop fastener for securing said base portion around the neck of the user.

4. The neck and ear protection device as set forth in claim 1, further comprising:

a cowl portion being coupled to said base portion, said cowl portion being positioned opposite said ear portions, said cowl portion being adapted for covering a portion of a back, front and shoulders of the user for protecting the skin of the portion of the back, front and shoulders from direct contact with heated air from the hair dryer.

5. The neck and ear protection device as set forth in claim 1, further comprising:

a securing portion being coupled to said base portion such that said securing portion extends between said ear portions, said securing portion being adapted for engaging a portion of a base of a skull of the user such that said securing portion is positioned adjacent a hair line of the user, said securing portion being adapted for protecting the skin of the portion of the base of the skull of the user from direct contact with heated air from the hair dryer.

6. The neck and ear protection device as set forth in claim 5, further comprising:

a position member being positioned in said securing portion, said position member being adapted for conforming to the portion of the base of the skull of the user.

7. The neck and ear protection device as set forth in claim 6, further comprising:

said position member comprising a substantially rigid material, said substantially rigid material being adapted for conforming to the portion of the base of the skull of the user for maintaining said securing portion against the base of the skull of the user.

8. A neck and ear protection device for protecting the ears and neck of a user from being burned when the user is using a hair dryer, the neck and ear protection device comprising:

a base portion being shaped for being positioned around the neck of the user, said base portion being adapted for protecting skin of the neck of the user from direct contact between the heated air of the hair dryer and the skin of the neck, said base portion comprising a rear portion and a pair of side portions, said side portions being oppositely coupled to said rear portion such that said side portions are selectively coupled together opposite said rear portion to form a cylinder. said rear portion being adpted for covering a back of the neck of the user such that each said side portions is for covering a side of the neck and a portion of the front of the neck to protect the neck from the heated air of the hair dryer, said base portion being adapted for extending the length of the neck to protect the neck from the heated air of the hair dryer;

a pair of ear portions being coupled to said base portion, each of said ear portions being positioned such that said ear portions are diametrically opposed when said base portion is positioned around the neck of the user, each of said ear portions being shaped for receiving one of the ears of the user, said ear portions being adapted for preventing direct contact between the heated air of the hair dryer and the skin of the ears;

a first fastening member being coupled adjacent a first free edge of said base portion, a second fastening member being coupled adjacent a second free edge of said base portion, said first fastening member being selectively couplable to said second fastening member for securing said base portion around the neck of the user;

said first fastening member comprising a first portion of hook and loop fastener, said second fastening member comprising a second portion of hook and loop fastener, said first portion of hook and loop fastener being complimentary to said second portion of hook and loop fastener such that said first portion of hook and loop fastener releaseably engages said second portion of hook and loop fastener for securing said base portion around the neck of the user;

a cowl portion being coupled to said base portion, said cowl portion being positioned opposite said ear portions, said cowl portion being adapted for covering a portion of a back, front and shoulders of the user for protecting the skin of the portion of the back front and shoulders from direct contact with heated air from the hair dryer;

a securing portion being coupled to said base portion such that said securing portion extends between said ear portions, said securing portion being adapted for engaging a portion of a base of a skull of the user such that said securing portion is positioned adjacent a hair line of the user, said securing portion being adapted for protecting the skin of the portion of the base of the skull of the user from direct contact with heated air from the hair dryer;

a position member being positioned in said securing portion, said position member being adapted for conforming to the portion of the base of the skull of the user; and said position member comprising a substantially rigid material, said substantially rigid material being adapted for conforming to the portion of the base of the skull of the user for maintaining said securing portion against the base of the skull of the user.

* * * * *